US007946424B2

(12) United States Patent
Gupta

(10) Patent No.: US 7,946,424 B2
(45) Date of Patent: May 24, 2011

(54) PORTABLE STORAGE CONTAINER FOR SMALL OBJECTS SUCH AS BEADS

(75) Inventor: Nikhil Gupta, Schaumburg, IL (US)

(73) Assignee: DPG USA Inc., Schaumburg, IL (US)

( * ) Notice: Subject to any disclaimer, the term of this patent is extended or adjusted under 35 U.S.C. 154(b) by 0 days.

(21) Appl. No.: 12/322,917

(22) Filed: Feb. 9, 2009

(65) Prior Publication Data

US 2010/0200436 A1 Aug. 12, 2010

(51) Int. Cl.
*B65D 71/00* (2006.01)
*B65D 73/00* (2006.01)
*A44C 25/00* (2006.01)

(52) U.S. Cl. ..... 206/575; 63/39; 206/472; 206/478

(58) Field of Classification Search ..... 206/6.1, 206/472–475, 523, 566, 574, 575, 477–483; 63/33, 37–39
See application file for complete search history.

(56) References Cited

U.S. PATENT DOCUMENTS

| | | | | | |
|---|---|---|---|---|---|
| 1,201,979 | A * | 10/1916 | Noyes | 206/478 |
| 1,746,054 | A * | 2/1930 | Ridabock | 63/33 |
| 2,282,908 | A * | 5/1942 | Thompson | 206/523 |
| 3,528,874 | A | 9/1970 | Spencer | |
| 3,804,239 | A * | 4/1974 | O'Brien | 206/523 |
| 4,720,012 | A * | 1/1988 | Dufour | 206/472 |
| 4,848,586 | A * | 7/1989 | Jasik | 206/566 |
| 4,895,748 | A | 1/1990 | Squires | |
| 5,059,452 | A | 10/1991 | Squires | |
| 5,353,921 | A * | 10/1994 | Tyra | 206/6.1 |
| 7,367,449 | B2 * | 5/2008 | Kaminski et al. | 206/6.1 |
| 2005/0178693 | A1 * | 8/2005 | Gupta | 206/574 |
| 2008/0011770 | A1 * | 1/2008 | Tobias | 221/189 |
| 2009/0038901 | A1 * | 2/2009 | Pomerantz | 206/523 |

* cited by examiner

*Primary Examiner* — Bryon P Gehman
(74) *Attorney, Agent, or Firm* — Robert S. Alexander

(57) ABSTRACT

A design board container enabling the arrangement and temporary positional securement of beading elements is provided. The container includes a base member and a lid member preferably in hinged relationship with one another. The base member and lid member include a design liner and lid liner, respectively, formed of a resiliently deformable and preferably compressible material. The liners are preferably substantially planar, i.e., a flat surface, so as to allow for free form designing unconstrained by preset channels. By closing the container, the lid surface engages the design surface and beading elements such that the beading elements deform the design liner and are positionally secured between the design liner and the lid liner. The surfaces of the lid liner and the design liner preferably comprise gripping members, such as filamentary or hair-like elements.

18 Claims, 3 Drawing Sheets

PORTABLE STORAGE CONTAINER FOR SMALL OBJECTS SUCH AS BEADS

CROSS-REFERENCE TO RELATED APPLICATION

This application claims priority to provisional patent application Ser. No. 61/063,953 filed on Feb. 7, 2008 entitled "Portable Bead Design Board"

TECHNICAL FIELD OF THE INVENTION

The present invention relates generally to containers for storing small objects such as beads, baubles, or other small objects used in jewelry, needlework, scrapbooking, or other crafts involving the use of small objects. In particular, the present invention relates to a portable design and storage container for use with beads and small objects associated with the creation of ornamental jewelry.

BACKGROUND OF THE INVENTION

Craft projects such as needlework, ornamental jewelry making frequently requires the use of small objects. These objects may include beads, sequins, buttons, pearls, charms, embellishments, needles, and other small items. While the description herein refers to beads and it should be understood that the storage container described herein can also benefit the storage of other small objects, such as tools used in craft projects.

Objects such as beads are often small and difficult to work with. For a given ornamental jewelry project, the project may involve the use of a number of beads of different shapes, sizes, and colors. Small tools, needles, and lengths of line, thread, or wire may also be involved. Since craftmakers may choose to work on a project in intervals, it is desirable to provide a container for storing the component pieces of the project in an organized manner that will be maintained during storage.

Portability of a crafts project is sometimes a desirable feature. In the event that an existing bead project needs to be stored and moved, it is desirable to maintain any organization or separation of beads and other small objects. While the items can be stored loose in conventional containers such as bags or cases, this results in the mixing and dispersal of the project components within the container and is contrary to maintaining good organization of the project components during storage between uses and during transport. Where the components include needles or other sharp objects, the jumbled scrambling of components within the container can present a danger when the user attempts to retrieve components from the container.

Storage of small objects can also be accomplished using pre-partitioned containers. While the partitions in this class of containers maintain separation of the component parts from each other, these containers are difficult to use and limit the user's freedom to arrange or layout component pieces in a project. It is desirable for a user to be able to lay out the component pieces in a custom configuration for storage and return to the same configuration after storage and transport without disturbing the position of the components. For example, it is desirable for the user to lay out a pattern of mixed beads in an arrangement for future use, or to arrange a partially assembled project for finishing at a later time. A pre-partitioned container is not able to accommodate storage of these or other arrangements in a freeform manner.

There is thus a need for a convenient and portable storage container that is capable of maintaining small objects and project components in an organized manner between uses. It is also desired that the container be configured in a way that maximizes the flexibility and options to the user in arranging the objects within the container. It is further desired that the container be able to maintain any custom organization, arrangements and configurations of the objects in place during storage and transport.

SUMMARY OF THE INVENTION

The design board container according to a preferred embodiment of the present invention allows for the arrangement and temporary positional securement of beading elements. The preferred design board comprises a base member defining a top surface and a bottom surface, a design liner secured with the top surface of the base member that provides a design surface for supporting the beading elements during arrangement of the beading elements.

The design liner is preferably substantially planar, i.e., a flat surface is provided to allow for free form designing that not constrained by preset channels. As such, the design liner should be substantially free of recesses for the bead elements. The design liner is also formed of a resiliently deformable material, such as a compressible foam, and is of a substantially uniform thickness.

A lid member that is preferably hinged with the base member is also provided. The lid member includes a top surface and a bottom surface. A lid liner is secured with the bottom surface of the lid member. Securement of the lid liner to the bottom surface may be by way of any known means, such as a hook and loop system, glue, tape, or merely friction fitting the liner with the lid. Similar to the design liner, the lid liner is also preferably of a substantially uniform thickness and defines a substantially planar lid surface. The lid member and the base member define similarly sized planar surfaces such that the lid member may be engaged with the base member in a closely fitting manner.

When the design board container is in a closed condition the lid surface engages the design surface and beading elements such that the beading elements deform the design liner and are positionally secured between the design liner and the lid liner. It is preferred that both the design liner and the lid liner are comprised of a compressible material, such as a compressible foam. As the design liner and lid liner are brought into contact with one another, bead elements on the design liner compress the design liner and lid liner such that the bead elements are secured in place. The surfaces of the lid liner and the design liner preferably comprise gripping members. These gripping members may include irregularities in the surface of the lid liner and design liner. The gripping members in a particular embodiment comprise a plurality of filamentary elements, such as hair-like protrusions the further secure the bead elements in place.

In use a designer may place and arrange bead elements on the design surface in any pattern he or she chooses. If he or she chooses to take a break from the design or to change location, he or she may secure the arrangement of the bead elements on the design surface by engaging the lid member such that the bead elements are sandwiched between the design surface and the lid surface. As discussed, this sandwiching cases the bead elements to deform at least the design liner, and thereby, hold the bead elements in place. The lid may then be secured with the base member, such as with a latch. The designer can later continue preparation of a bead design by disengaging the lid member from the base member and opening the lid member.

While the descriptions provided thus far have addressed a design board container for bead related craftwork, it should be understood that the present invention is not limited as such. For example, other items of varying sizes, such as fishing lures, may be arranged and secured in a similar device by incorporating liners of appropriate thickness to the items to be stored.

DESCRIPTION OF THE PREFERRED EMBODIMENTS

Figure 1:
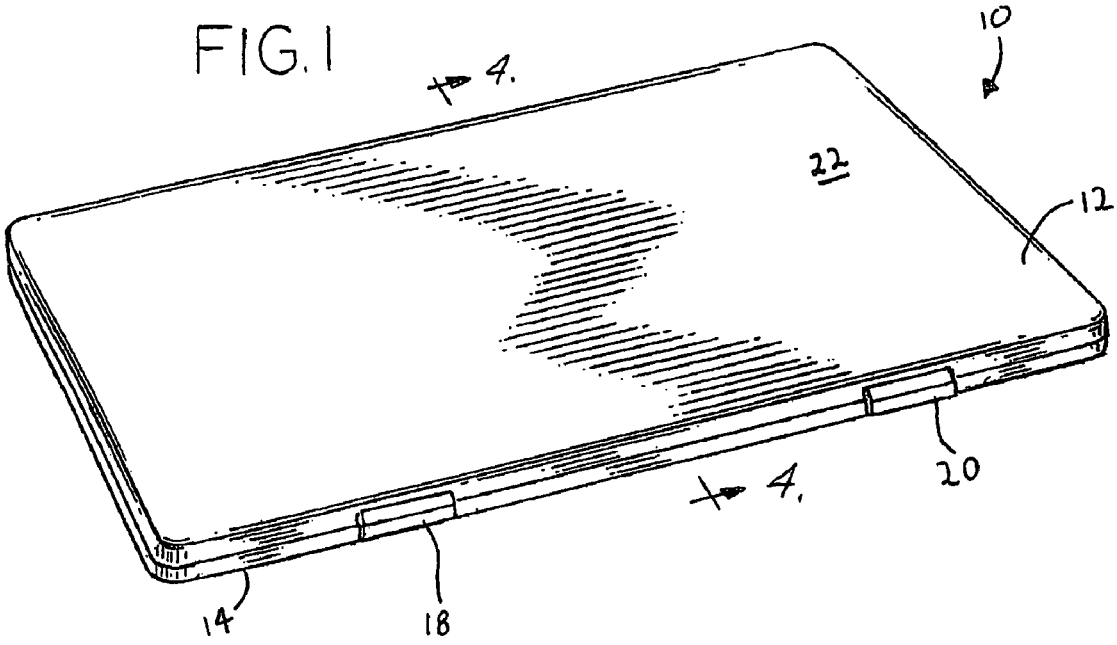
FIG. 1 is a perspective view of a preferred embodiment of the present invention in a closed condition.
Figure 2:
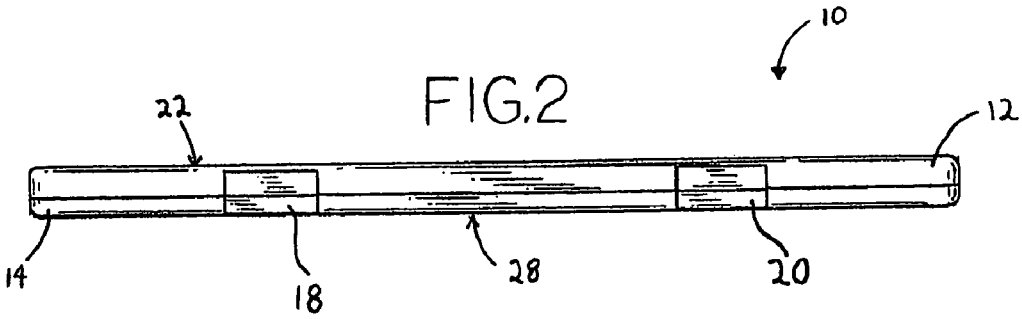
FIG. 2 is a front elevated view of the embodiment of FIG. 1.
Figure 3:
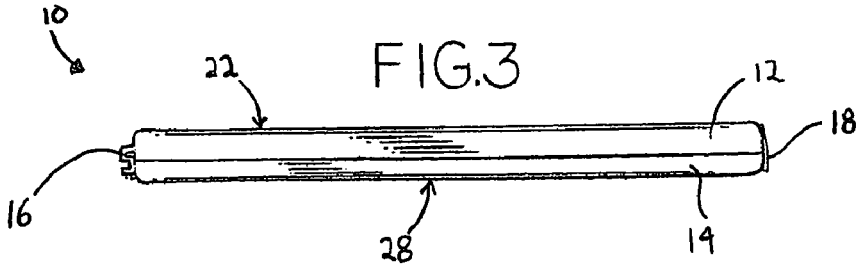
FIG. 3 is a side elevated view of the embodiment of FIG. 1.

A preferred embodiment of the present invention will now be described. Referring to FIGS. 1-3, the portable container 10 is preferably thin in shape, capable of holding small objects in a single layer. The container 10 is preferably made of a lightweight but durable material such as plastic for ease of portability and inexpensive manufacturing. It should be understood that other materials can be used, such as aluminum or wood.

Figure 4:
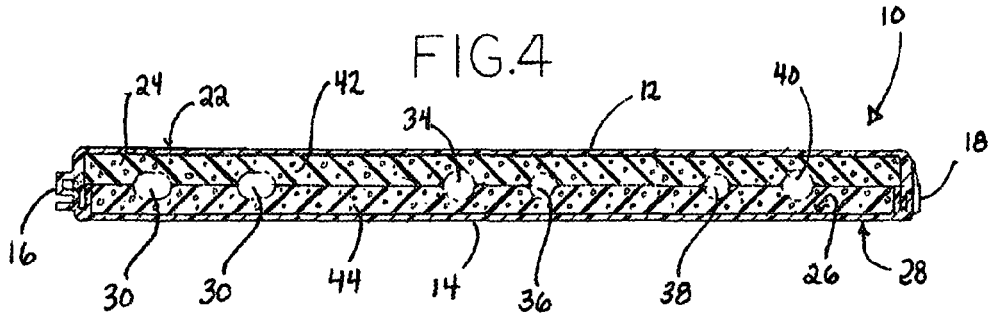
FIG. 4 is a cross sectional view of the embodiment of FIG. 1 as viewed along the line 4-4 shown in FIG. 1.

The container 10 can be opened or closed by means of a lid 12 having a top surface 22 and a bottom surface 24 (FIG. 4). The lid is preferably hinged to the base 14 of the container. The base 14 also has a top surface 26 (FIG. 4) and a bottom surface 28. The container can be secured in a closed position by means of a latch, lock, or other securement mechanism.

As will be discussed in further detail below, the interior of the container 10 is set up such that when closed, such as shown in FIG. 1, objects within the container 10 are prevented from movement. The lid member 12 and base member 14 are preferably connected to one another by a hinge member 16. In the closed position, the lid member 12 and the base member 14 are secured to one another by latches 18 and 20, which may be integrally formed with either of the lid 12 or base 14.

Figure 5:
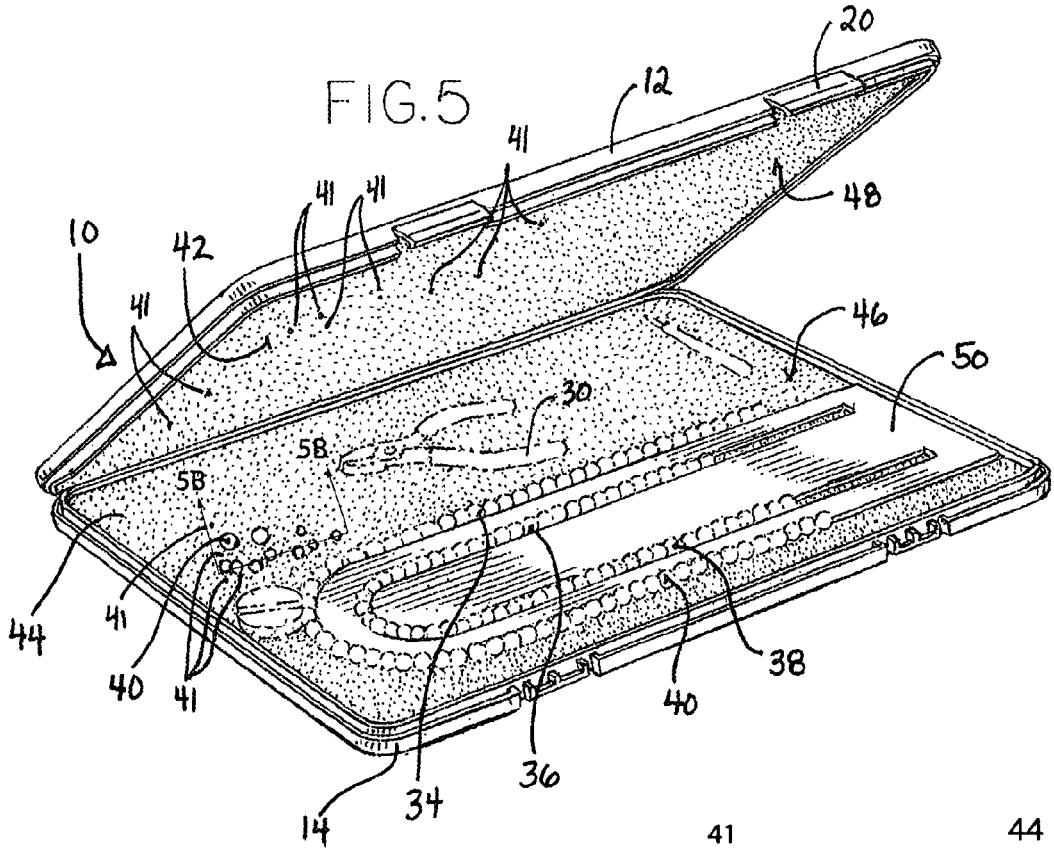
FIG. 5 is a perspective view of the embodiment of FIG. 1 in a partially opened condition.
Figure 5B:
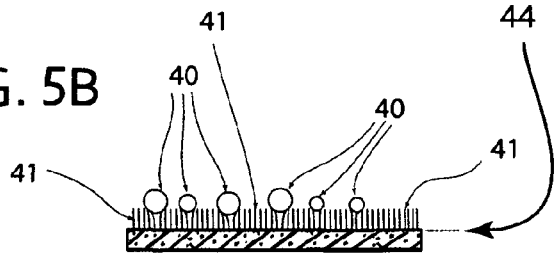
FIG. 5B is a sectional view of FIG. 5 illustrating bead elements on the design surface and their interrelation with the gripping members.

Referring to FIGS. 4 and 5, there is shown bead elements 30, 34, 36, 38 and 40 being securely held within the container 10. The lid 12 is provided with a lid liner 42. The lid liner 42 is composed of a material that is resiliently deformable, and preferably compressible. A preferred suitable material for use as the lid liner 42 is a padding known as Vellux®. Similar to the lid 12, the base 14 has a design liner 44 of similar construction secured herewith. Free form design may be accomplished on the design surface 46. Securement of the design liner 44 to the base 14 and the lid liner 42 to the lid 12 may be by any method known in the art such as tape, adhesive, hook and loop enclosure or friction fitting.

When the lid 12 is secured with base 14, bead elements 30, 34, 36, 38, and 40 are securely held within the container. As shown in FIG. 4, the various beading elements are sandwiched between the lid liner 42. By closing the lid 12, the lid liner 42 and the design liner 44 are compressed such that the beading elements are surrounded and secured by the lid liner 42 and design liner 44. It should be understood that in some embodiments, the lid liner may not compress or deform.

Referring to FIG. 5, the design surface 46 includes a plurality of gripping members, such as filamentary or hair-like members 41. These filamentary members 41 enhance the ability of the design liner 44 and lid liner 42 to securely hold bead elements 40, including very small beads in place. The particular compressible material can be any suitable material known in the art such a open cell or closed cell polymeric materials. In a preferred embodiment, the lid liner 42 and design liner 44 preferably compress so as to conform to the shape of the objects contained within therebetween so as to hold them in place by friction when the lid 12 is closed. It should be understood that the liner can be made of any other material suitable to inhibit motion of objects without damaging them such as fabric, felt, neoprene.

Figure 6:
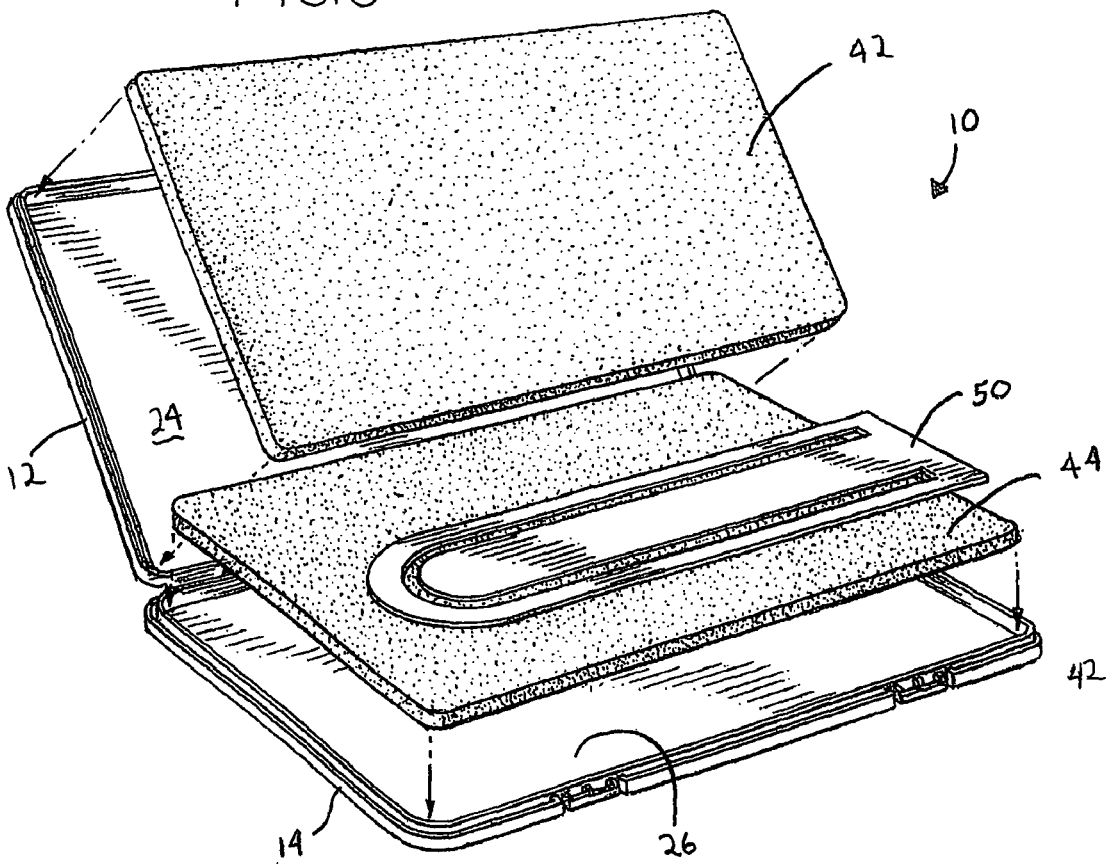
FIG. 6 is an exploded view of the embodiment of FIG. 1.
Figure 7:
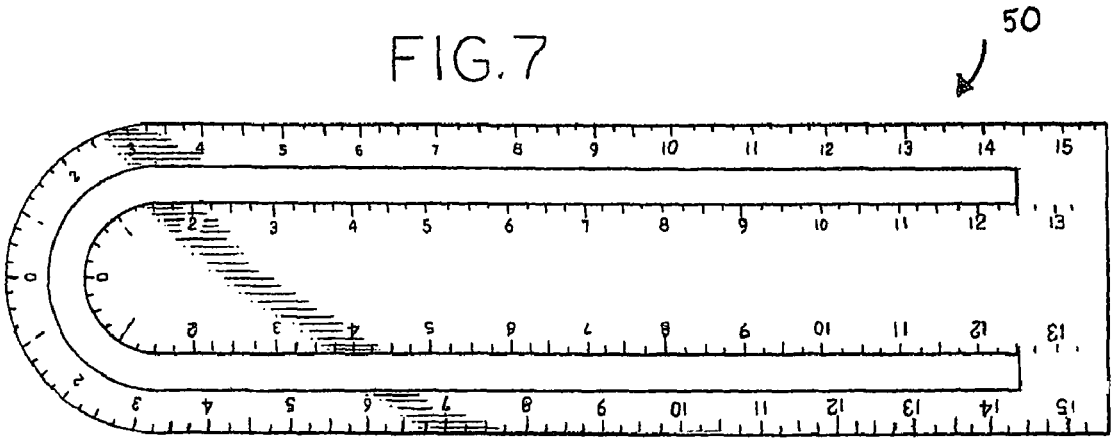
FIG. 7 is an exploded view of an example of a beading tool that may be placed within the present invention.

Referring to FIG. 6, it is preferred that the lid liner 42 and the design liner 44 are removable to enable replacement of any damaged or worn liners without requiring replacement of the entire container 10. Shown in FIGS. 5 and 6 is an optional design template 50 that may be used by the designer to arrange beads. It should be understood that bead are a type of bead element, and that other bead elements can include tools, such as pliers 30.

To assist in the portability of the container, the container may contain handles, straps, or be packaged with a carrying device. As previously described, it is preferred that the container be lightweight and dimensioned in a way to avoid bulkiness to promote ease of transport from place to place.

In operation, the user puts bead elements to be held, such as beads 34, 36, 38, and 40, pliers 30, or a partially completed necklace into the container 10. The lid 12 of the container 10 is then closed. When closed, the lid liner 42 and the design liner 44 come into frictional contact with the contents of the container, as well as conform to the shape of the items. This frictional contact holds the contents of the container in place. For added security, the container can be latched and secured in the closed position before being stored or transported.

Due to the frictional contact between the liner and the contents of the container, movement of the objects within the container during transport, storage, or jostling is prevented. By preventing movement of the objects, this assures that the configuration of objects within the container remains intact when the container is reopened.

While the various descriptions of the present invention are described above, it should be understood that the various features can be used singly or in combination thereof. Therefore, this invention is not to be limited to the specific preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention.

I claim:

1. A container for the arrangement and temporary positional securement of beading elements, the container comprising:

a base member defining a top surface and bottom surface, a fabric design liner secured with the top surface of the base member, the design liner being resiliently deformable and being of substantially uniform thickness, the design liner defining a substantially planar design surface for supporting the beading elements during arrangement of the beading elements, the design liner being substantially free of recesses for the bead elements to allow for free-form designing, and the design liner including a plurality of hair-like filamentary gripping members adapted to engage beading elements for retaining a free-form design of beading elements on the design liner without recesses when the container is in the open condition;

a lid member defining a top surface and a bottom surface;

a lid liner comprising a layer of resiliently deformable material secured with the bottom surface of the lid member, the lid liner being of substantially uniform thickness and defining a substantially planar lid surface; and the lid member being engageable with the base member such that when the container is in a dosed condition the lid surface engages the design surface and beading elements such that the beading elements resiliently deform the design liner and are positionally secured between the design liner and the lid liner.

2. The container of claim 1, wherein the design liner is a compressible material.

3. The container of claim 1 further comprising a design template for use in arranging beads.

4. The container of claim 1 wherein the design liner comprises a layer of flocked foam fabric comprising synthetic flock fibers adhered to a layer of closed-cell foam.

5. The container of claim 4 wherein the foam comprises polyurethane and the synthetic flock fibers comprise nylon.

6. The container of claim 4 wherein the flocked foam fabric has upright flock fibers forming a stand up pile.

7. The container of claim 1 wherein the design liner and the lid liner each comprise a layer of flocked foam fabric comprising synthetic flock fibers adhered to a layer of closed-cell foam.

8. A method of preparing a bead design, the method comprising:

placing bead elements on a design surface of a substantially planar fabric design liner secured to a base member defining a top surface and a bottom surface, the design liner being of substantially uniform thickness and defining a substantially planar design surface for supporting the beading elements during arrangement of the beading elements, the design liner being substantially free of recesses for the bead elements to allow for free-form designing; the design surface comprising a plurality of hair-like gripper filamentary members adapted to engage beading elements for retaining a free-form design of beading elements without recesses;

arranging the bead elements on the design surface;

securing the arrangement of the bead elements on the design surface by engaging a lid member defining a top surface and a bottom surface and comprising a lid liner with the base member, a hinge member connecting an edge of the base member with an edge of the lid member, the lid liner being substantially uniform thickness and defining a substantially planar lid surface, the lid surface including a plurality of hair-like gripper filamentary members adapted to engage beading elements, wherein securing the position of the bead elements comprises:

sandwiching bead elements between the design surface and the lid surface and causing the bead elements to deform the design liner;

securing the lid with the base liner with a latch member adapted to secure an edge of the base member opposite the hinge member to an edge of the lid member opposite the hinge member;

continuing preparations of the bead design by disengaging the lid member from the base member such that the bead elements are no longer sandwiched between the design surface and the lid surface.

9. The method of claim 8, wherein the design liner is a compressible material.

10. The method of claim 8, wherein the design surface comprises at least one gripping member adapted to engage beading elements.

11. The method of claim 10, wherein the at least one gripping member comprises a plurality of filamentary members.

12. The method of claim 8, wherein the lid liner is resiliently deformed and the lid surface comprises at least one gripping member adapted to engage beading elements, and wherein sandwiching bead elements between the design surface and, the lid surface further comprises causing the bead elements to deform the lid liner.

13. The method of claim 12, wherein the at least one gripping member of the lid surface comprises a plurality of filamentary members.

14. A container for the arrangement and temporary positional securement of beading elements, the container comprising:

a base member defining a top surface and a bottom surface, a fabric design liner secured with the top surface of the base member, the design liner being a resiliently deformable and compressible material, the design liner having a substantially uniform thickness and a substantially planar design surface for supporting the beading elements during arrangement of the beading elements, the design liner further being substantially free of recesses for the bead elements to allow for free-form designing; the design surface comprising a plurality of hair-like gripper filamentary members adapted to engage beading elements for retaining a free-form design of beading elements without recesses;

a lid member defining a top surface and a bottom surface;

a lid liner secured with the bottom surface of the lid member, the lid liner being a resiliently deformable and compressible material, the lid liner having a substantially uniform thickness and a substantially planar lid surface, the lid surface including a plurality of hair-like gripper filamentary members adapted to engage beading elements;

a hinge member connecting an edge of the base member with an edge of the lid member, and a latch member adapted to secure an edge of the base member opposite the hinge member to an edge of the lid member opposite the hinge member.

15. The container of claim 14 further comprising a design template for use in arranging beads.

16. The container of claim 14 wherein the design liner and the lid liner each comprise a layer of flocked foam fabric comprising synthetic flock fibers adhered to a layer of closed-cell foam.

17. The container of claim 16 wherein the foam comprises polyurethane and the synthetic flock fibers comprise nylon.

18. The container of claim 16 wherein the flocked foam fabric has upright flock fibers forming a stand up pile.

* * * * *